US007658269B2

(12) United States Patent
Wu

(10) Patent No.: US 7,658,269 B2
(45) Date of Patent: Feb. 9, 2010

(54) HANDLE OF A TWO PULLING ROD SUITCASE

(76) Inventor: Chen-Chuan Wu, No. 9-3, Wu-Chiuan One Road, Hsin Chuang City, Taipei Hsien (TW)

( * ) Notice: Subject to any disclaimer, the term of this patent is extended or adjusted under 35 U.S.C. 154(b) by 703 days.

(21) Appl. No.: 11/352,983

(22) Filed: Feb. 13, 2006

(65) Prior Publication Data

US 2007/0187202 A1 Aug. 16, 2007

(51) Int. Cl.
*A45C 13/26* (2006.01)

(52) U.S. Cl. ..... 190/115; 16/113.1

(58) Field of Classification Search ..... 190/115; 16/113.1

See application file for complete search history.

(56) References Cited

U.S. PATENT DOCUMENTS 1,375,938 A * 4/1921 Slack ..... 401/130
1,619,916 A * 3/1927 Brewster ..... 267/91
5,438,731 A * 8/1995 Kazmark, Jr. ..... 16/113.1
5,819,892 A * 10/1998 Deliman et al. ..... 190/115
5,984,064 A * 11/1999 Byington ..... 190/115
6,374,457 B1 * 4/2002 Kuo ..... 16/113.1
6,450,308 B1 * 9/2002 Kuo ..... 190/115

* cited by examiner

*Primary Examiner*—Tri M Mai
(74) *Attorney, Agent, or Firm*—Cheng-Ju Chiang

(57) ABSTRACT

A handle of a two pulling rod suitcase includes a handle body and a pulling rod device disposed at opposite ends of the handle body. The handle body includes a casing pivotably disposed with a hinge member. The hinge member is disposed with a tooth portion at the outside thereof. The hinge member is connected with a spring for return. The casing at least includes first and second connecting members at opposite sides thereof. The first and second connecting members are mated with the tooth portion. Outer ends of the first and second connecting members are respectively disposed with first and second pressing members. The pulling rod device includes two pulling rod units and a transmission member. Each pulling rod member includes at least one pulling rod. The transmission member is pivotably disposed in the pulling rod. The transmission member is connected with the first and second connecting members or the first and second pressing members.

14 Claims, 4 Drawing Sheets

HANDLE OF A TWO PULLING ROD SUITCASE

FIELD OF THE INVENTION

The present invention relates to a handle of a suitcase, and particularly to a handle of a two pull rod suitcase which enables the handle to be ready to press in use thereby increasing controllability and comfortability thereof.

BACKGROUND OF THE INVENTION

A suitcase is a common instrument to the modernist for containing articles during traveling or going aboard. A common suitcase may be configured with one pulling rod or two pulling rods for pulling the suitcase. Since two pulling rods have a better supportability to the suitcase in use, the two pulling rods may be configured to a relatively large-scale suitcase or a suitcase which is focused to structure and operation stability. So the two pulling rod suitcase is still a main style of the pulling suitcase. A two pulling rod suitcase is mainly disposed with a pair of pulling rods at a suitcase body thereof. The upper ends of the two pulling rods are connected with a handle. The handle is disposed with a button. The protraction and retraction operation of the pair of pulling rods can be controlled through pressing the button of the handle. However, since a palm of a person holds at the handle during pulling and holding the suitcase and the button is just located at the inner side of the center of the palm, inconvenience and unhandiness in operation is caused. Customarily, it is required to stop, release the hand and change the position of the hand and then press the button through fingers, which is not fit well to ergonomics. Furthermore, since the thumb of a hand can singly and sidewards extend when the hand holds the handle, and since the control agility of the thumb is better than that of the palm, if convenience of controlling the button of the handle is further improved, a technical solution fitting to ergonomics can be reached.

Therefore, it is desired to improve a handle of a two pulling rod suitcase to have more controlling convenience, comfort and operation sense of reality.

SUMMARY OF THE INVENTION

The present invention is to provide a handle of a two pulling rod suitcase which has convenience at button control when the handle is hold thereby facilitating to protract or retract pulling rods.

Another, the present invention is to provide a handle of a two pulling rod suitcase which can conduct button operation at opposite sides of the handle to protract or retract pulling rods thereby fitting to use habit of different operators and so increasing additional value and market competition of the two pulling rod suitcase.

Accordingly, a handle of a two pulling rod suitcase of the present invention includes a handle body and a pulling rod device disposed at opposite ends of the handle body. The handle body comprises a casing. The casing is pivotably disposed with a hinge member. The hinge member is disposed with a tooth portion at the outside thereof. The hinge member is connected with a spring for return. The casing at least comprises first and second connecting members at opposite sides thereof. The first and second connecting members are mated with the tooth portion of the tooth portion. Outer ends of the first and second connecting members are respectively disposed with first and second pressing members. The pulling rod device comprises two pulling rod units and a transmission member. Each pulling rod member comprises at least one pulling rod. The transmission member is pivotably disposed in the pulling rod. The transmission member is connected with the first and second connecting members or the first and second pressing members.

These and other embodiments, aspects and features of the invention will be better understood from a detailed description of the preferred embodiments of the invention, which are further described below in conjunction with the accompanying figures.

DETAILED DESCRIPTION OF THE PREFERRED EMBODIMENTS

Figure 1:
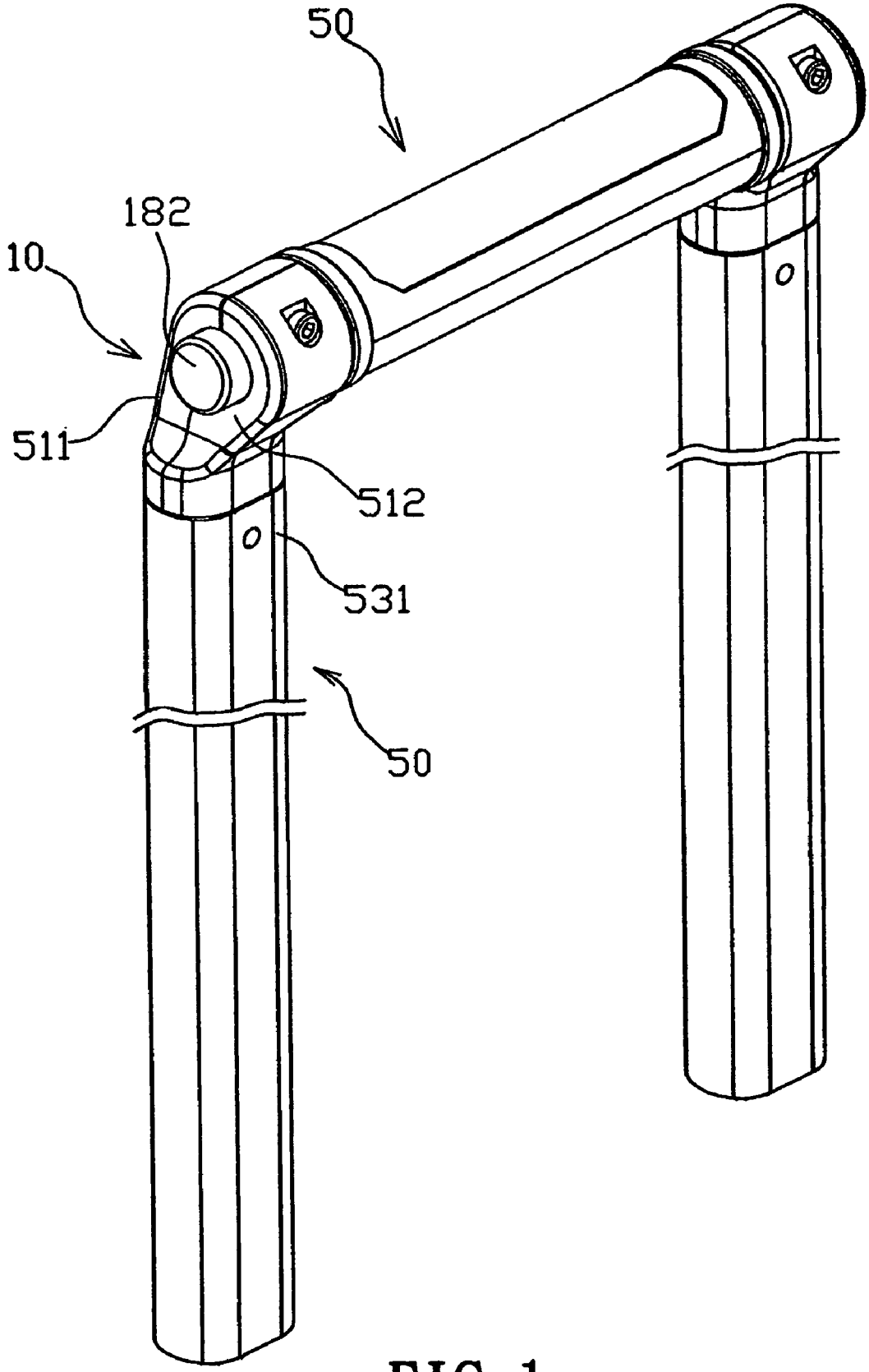
FIG. 1 is a perspective view of the present invention.
Figure 2:
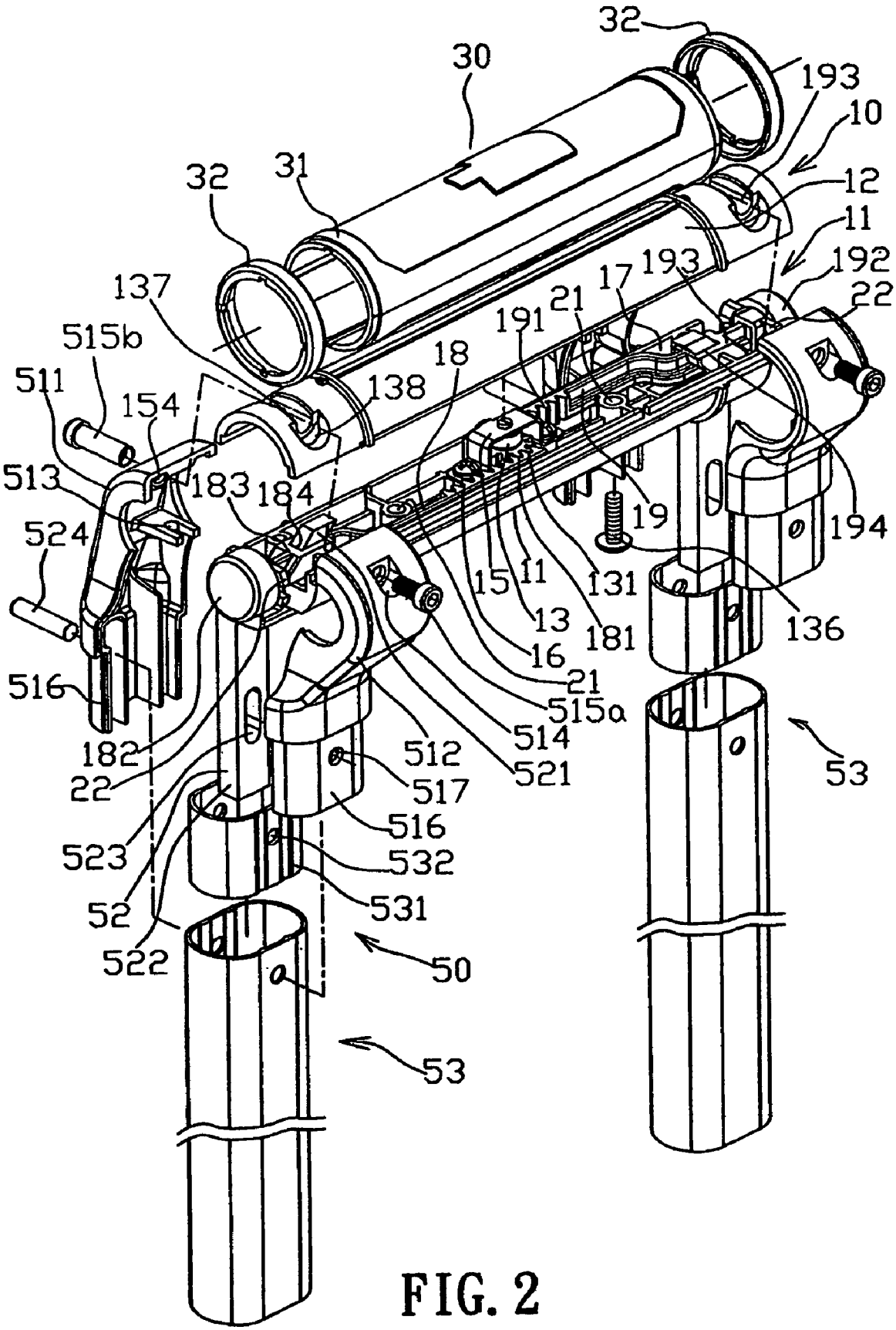
FIG. 2 is an exploded view of the present invention.
Figure 3:
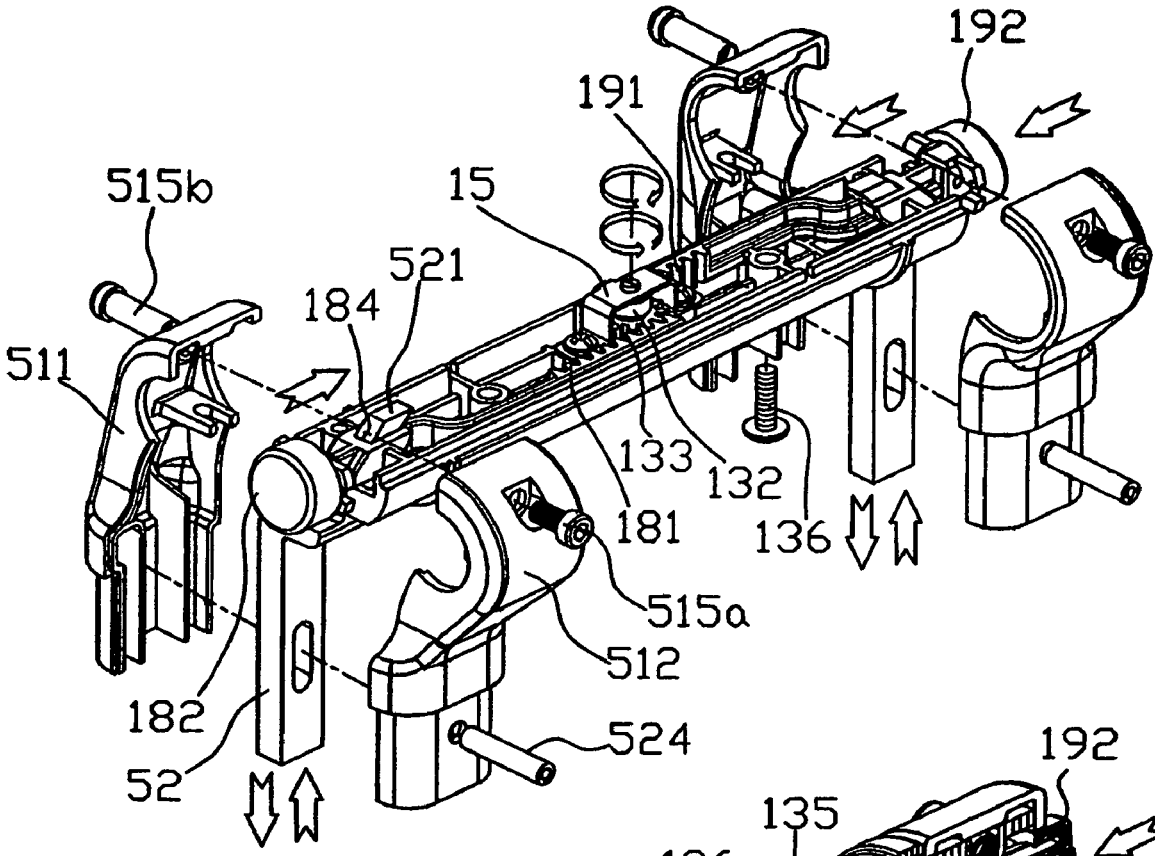
FIG. 3 is a schematic view showing operation of the present invention.
Figure 4:
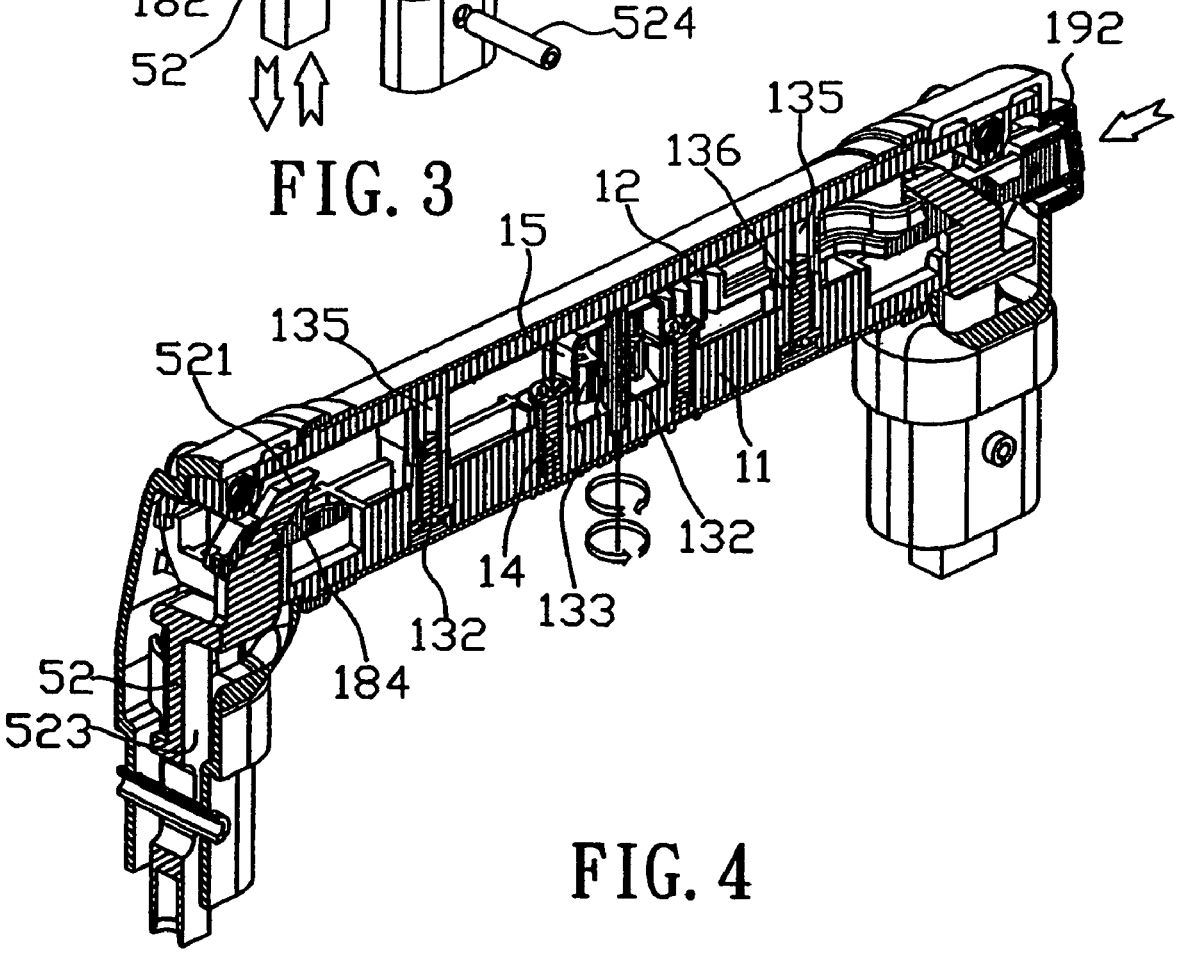
FIG. 4 is a cross-sectional view of the present invention.

Referring to FIGS. 1-4, a handle of a two pulling rod suitcase of the present invention includes a handle body 10, a holding device 30 and a pulling rod device 50. The handle body 10 includes a casing 11. The casing 11 includes a lower case 11 and an upper case 12. The lower case 11 is pivotably disposed with a hinge member 13 at the inside thereof and near the center thereof. The hinge member 13 is disposed with an annular tooth portion 131 at the outside thereof. The hinge member 13 is positioned at the lower case 11 in the inside thereof through a pivot shaft 132 and a volute spring 133 and has turning resilience for rotation and return operation of the hinge member 13. The lower case 11 is defined with a positioning hole 14 respectively at opposite sides of the hinge member 13. A curved positioning member 15 is screwedly fixed above the hinge member 13 through the positioning hole 14 for restricting position of the hinge member 13. The lower case 11 at least has a first embedding groove 16 and a second embedding groove 17 at opposite sides thereof. The first and second embedding grooves 16, 17 may be configured in a reverse corresponding manner. The first and second embedding grooves 16, 17 are respectively embedded with first and second connecting members 18, 19. The first and second connecting members 18, 19 are respectively disposed with first and second tooth portions 181, 191 at an end thereof corresponding to the hinge member 13. The first and second tooth portions 181, 191 are mated with the tooth portion 131 and positioned at opposite sides of the tooth portion 131. Outer ends of the first and second connecting members 18, 19 are respectively disposed with first and second pressing members 182, 192. Furthermore, the first and second connecting members 18, 19 are respectively disposed with first and second pushing seats 183, 193 at proper positions thereof. The first and second pushing seats 183, 193 are respectively defined with first and second pushing grooves 184, 194 each having a taper pitch. In addition, the lower case 11 is disposed with a plurality of fixing holes 21 and clipping blocks 22 at opposite ends thereof. The upper case 12 is disposed with a plurality of fixing screw holes 135 corresponding to the fixing holes 21 of the lower case 11 for fixing the lower and upper cases 11, 12 through a screw 136. The upper case 12 is defined with positioning recesses 137 in the top of opposite ends thereof. An abutting recess 138 is further defined below the positioning recess 137.

The holding device 30 is disposed at the outer side of the handle body 10 and includes an outer cover 31 and two end rings 32. The outer cover 31 is made from a flexible material for sleevingly covering the lower and upper cases 11, 12 and is positioned by the end rings 32.

The pulling rod device 50 is disposed at opposite ends of the handle body 10 and includes two pulling rod connecters 51, a transmission member 52 and a pulling rod unit 53. The pulling rod connecter 51 includes first and second connecter members 511, 512. The first and second connecter members 511, 512 are respectively disposed with a blocking board 513 and a positioning hole 514. The blocking board 513 is embedded in the clipping block 22 of the lower case 11. The positioning hole 514 can fix the first and second connecter members 511, 512 at the opposite ends of the handle body 10 through screw members 515*a*, 515*b*. A connecting portion 516 is respectively disposed below the first and second connecter members 511, 512. The connecting portion 516 is defined with a connecting hole 517. The transmission member 52 is a curved pole and includes a transmission pushing portion 521 at an upper portion thereof and a transmission connecting portion 522 at a lower portion thereof. The transmission pushing portion 521 is in a shape of taper and extends through the first pushing groove 184 of the first pushing seat 183 (similarly extending through the second pushing groove 194 of the second pushing seat 193). The transmission connecting portion 522 is disposed the first and second connecter members 511, 512. An elongate slot 523 is defined in the transmission connecting portion 522. A pin 524 extends through the connecting hole 517 and the slot 523 for positioning the transmission member 52 and enabling the transmission member 52 to longitudinally move. Thus, the transmission member 52 and the first and second connecting members 18, 19 (or the first and second pressing members 182, 192) are connected to move. The pulling rod unit 53 includes at least one pulling rod 531 (or consisting of a plurality of pulling rods). A connecting hole 532 is defined in the top end of the pulling rod 531. The pin 524 extends through the connecting hole 532 to fix the pulling rod 531 below the pulling rod connecter 51 and to enable the transmission member to pivotably dispose in the pulling rod 531.

Figure 5:
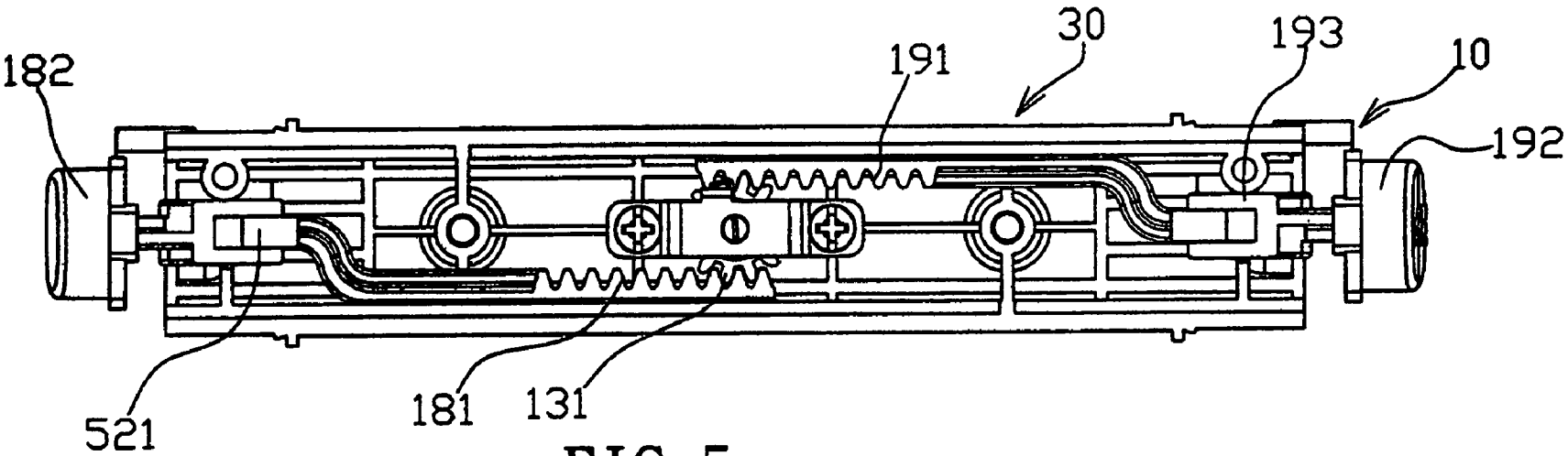
FIG. 5 is a top plan view of an assembly of the present invention.
Figure 6:
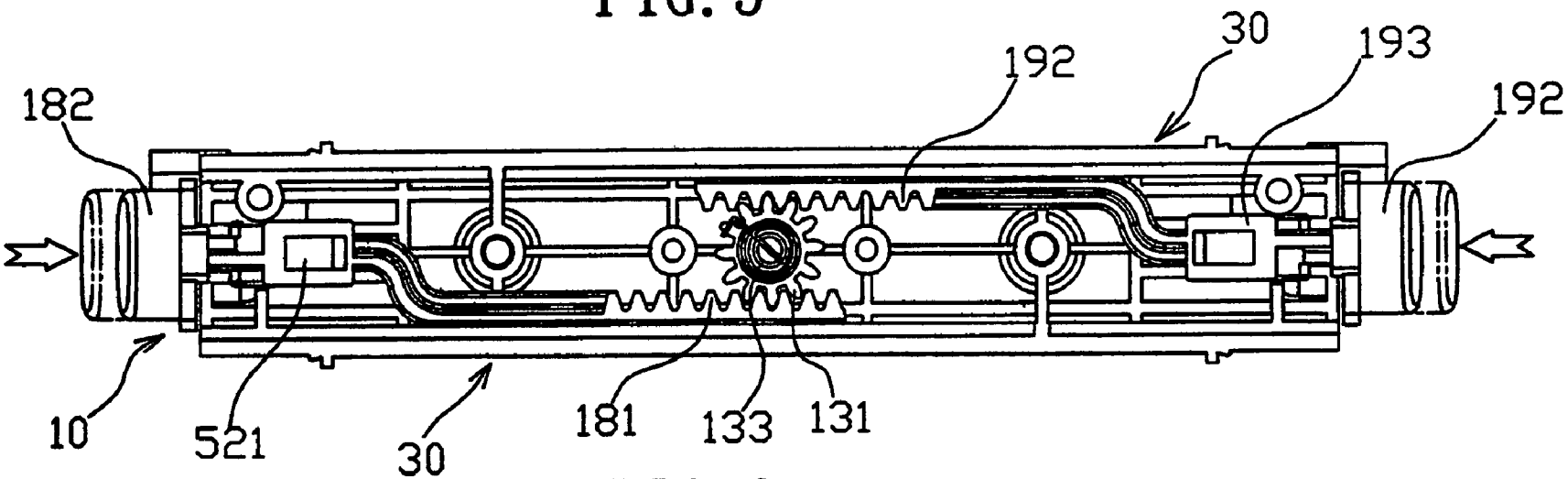
FIG. 6 is a schematic view showing operation of the present invention.

Referring to FIGS. 1 and 5, when a user holds the holding device 30 at the outer side of the handle body 10 with a hand thereof, the thumb of the hand just locates at the first or second pressing member 182, 192 at the end of the handle body 10. When it is desired to protract or retract the pulling rod device 50, the first pressing member 182 is pressed (or the second pressing member 192, hereinafter the first pressing member 182 is described as an example). Referring to FIG. 6, the first pushing seat 183 pushes the transmission pushing portion 521 to drive the transmission connecting portion 522 (that is to move up and down). The transmission connecting portion 522 may transmit and connect to a locking mechanism (not labeled) in the pulling rod device 50 for conducting the operation to protract or retract the pulling rod device 50.

Furthermore, when the first pressing member 182 is pressed, the first tooth portion 181 of the first connecting member 18 is mated with the tooth portion 131 of the hinge member 13 and drives the second tooth portion 191 mated with the tooth portion 131 thereby enabling the second connecting member 19 to reversely move at the same time. The second connecting member 19 drives the transmission member 52 at the second pushing seat 193 to enable the transmission member 52 to drive the pulling rod device 50 at the other end to protract or retract.

It is noted that since the first and second pressing members are respectively disposed at opposite sides of the handle body, whether a user holds the handle body in his left or right hand or clockwise or anti-clockwise holds the handle body with his palm, it is convenient to press the pressing member through his thumb thereby facilitating the operation to protract or retract the pulling rod device.

Therefore, the handle of a two pulling rod suitcase of the present invention is disposed with the holding device at the handle body to enable the handle body to have better holding stability, comfort and holding sense of reality through the flexible outer cover thereby greatly eliminating hand discomfort during holding the handle body and greatly increasing sense of reality of the handle.

The preferred embodiments, aspects, and features of the invention have been described in detail. It will be apparent to those skilled in the art that numerous variations, modifications, and substitutions may be made without departing from the spirit of the invention as disclosed and further claimed below.

What is claimed is:

1. A handle of a two pulling rod suitcase, comprising:

a handle body comprising a casing, the casing being pivotably disposed with a hinge member, the hinge member being disposed with a tooth portion at outside thereof, the hinge member being connected with a spring for return, the casing at least comprising a first and a second connecting members at opposite sides thereof, the first and the second connecting members being mated with the tooth portion, outer ends of the first and the second connecting members being respectively disposed with a first and a second pressing members;

a pulling rod device disposed at opposite ends of the handle body and comprising two pulling rod units and a transmission member, each pulling rod member comprising at least one pulling rod, the transmission member being slidingly connected to the pulling rod, the transmission member being connected with the first and the second connecting members or the first and the second pressing members, wherein the casing further includes an upper case and a lower case for receiving the hinge member, wherein the pulling rod device further includes two pulling rod connecters, each pulling rod connecter includes a first and a second connecter members connected with each other, and wherein the first and the second connecter members are respectively disposed with a blocking board and a positioning hole, the blocking board is embedded in a clipping block of the lower case.

2. The handle of a two pulling rod suitcase of claim 1, wherein the hinge member is pivotably disposed at the lower case through a pivot shaft.

3. The handle of a two pulling rod suitcase of claim 1, wherein the spring is a volute spring.

4. The handle of a two pulling rod suitcase of claim 1, wherein the lower case is disposed with a positioning member for restricting position of the hinge member.

5. The handle of a two pulling rod suitcase of claim 1, wherein the lower case has a first embedding groove and a second embedding groove at opposite sides thereof for respectively embeddingly receiving the first and second connecting members.

6. The handle of a two pulling rod suitcase of claim 1, wherein the upper and the lower cases are disposed with fixing holes connected with each other.

7. The handle of a two pulling rod suitcase of claim 1, wherein the upper case is defined with positioning recesses in top of opposite ends thereof.

8. The handle of a two pulling rod suitcase of claim 1, further comprising a holding device which is disposed at outer side of the handle body and includes an outer cover made from a flexible material.

9. The handle of a two pulling rod suitcase of claim 1, wherein a connecting portion is respectively disposed below the first and the second connecter members, the connecting portion is defined with a connecting hole, an elongate slot is defined in the transmission member corresponding to the connecting hole, a pin extends through the connecting hole and the slot.

10. The handle of a two pulling rod suitcase of claim 9, wherein a connecting hole is defined in top end of the pulling rod corresponding to the connecting hole of the connecting portion.

11. The handle of a two pulling rod suitcase of claim 5, wherein the first and second embedding grooves are configured in a reverse corresponding manner.

12. The handle of a two pulling rod suitcase of claim 5, wherein the first and second connecting members are respectively disposed with a first and a second tooth portions for mating with the tooth portion.

13. The handle of a two pulling rod suitcase of claim 5, wherein the first and the second connecting members are respectively disposed with a first and a second pushing seats at predetermined positions thereof.

14. The handle of a two pulling rod suitcase of claim 13, wherein the first and the second pushing seats are respectively defined with a first and a second pushing grooves for extension of the connecting members.

* * * * *